United States Patent [19]

Huijnen

[11] 4,346,935

[45] Aug. 31, 1982

[54] METHOD FOR FRAGMENTING OIL SHALE FORMATION

[75] Inventor: Wilhelmus G. J. Huijnen, Gouda, Netherlands

[73] Assignee: Occidental Oil Shale, Inc., Grand Junction, Colo.

[21] Appl. No.: 207,480

[22] Filed: Nov. 17, 1980

[51] Int. Cl.[3] ..... E21C 41/10

[52] U.S. Cl. ..... 299/2; 102/312; 299/13

[58] Field of Search ..... 299/2, 13; 166/299; 102/311, 312

[56] References Cited

U.S. PATENT DOCUMENTS

| | | | |
|---|---|---|---|
| 3,466,094 | 9/1969 | Haworth et al. | 299/13 |
| 3,863,987 | 2/1975 | Lampard | 102/312 X |
| 3,980,339 | 9/1976 | Heald et al. | 299/2 |

OTHER PUBLICATIONS

SME Mining Engineering Handbook, 1973, vol. 1, pp. 10–81 to 10–88, 11–96 to 11–98.

Langefors & Kihlstrom, "The Modern Technique of Rock Blasting," 1963, pp. 296–321.

Blasters' Handbook, DuPont, 15th Ed., pp. 246–247, 412–419.

*Primary Examiner*—Ernest R. Purser

*Attorney, Agent, or Firm*—Christie, Parker & Hale

[57] ABSTRACT

A subterranean formation containing oil shale is prepared for in situ retorting by initially excavating a void in a lower portion of a retort site. A primary sub-round of explosive is placed in a portion of formation within the retort site above the void, and a secondary sub-round of explosive is also placed in unfragmented formation above the void. In one embodiment, the primary sub-round comprises explosive placed in separate pairs of longitudinally spaced apart upwardly converging blasting holes. Explosive in the primary sub-round is detonated for fracturing unfragmented formation along a boundary defined by the upwardly converging blasting holes to separate a portion of formation from adjacent unfragmented formation for forming at least one new face above the separated portion of formation. The separated formation contains the secondary sub-round which is detonated after the separated formation commences moving under gravity toward the void, and before the separated formation reaches the bottom of the void, for explosively expanding the separated formation toward the new face and toward the void for forming at least a portion of a fragmented permeable mass of formation particles in an in situ oil shale retort.

29 Claims, 8 Drawing Figures

METHOD FOR FRAGMENTING OIL SHALE FORMATION

BACKGROUND

This invention relates to in situ recovery of shale oil, and more particularly, to rock fragmentation techniques for forming a fragmented permeable mass of formation particles containing oil shale in an in situ oil shale retort.

The presence of large deposits of oil shale in the Rocky Mountain region of the United States has given rise to extensive efforts to develop methods for recovering shale oil from kerogen in the oil shale deposits. It should be noted that the term "oil shale" as used in the industry is in fact a misnomer; it is neither shale, nor does it contain oil. It is a sedimentary formation comprising marlstone deposit with layers containing an organic polymer called "kerogen", which upon heating decompose to produce liquid and gaseous products. It is the formation containing kerogen that is called "oil shale" herein, and the liquid hydrocarbon product is called "shale oil."

A number of methods have been proposed for processing oil shale which involve either first mining the kerogen-bearing shale and processing the shale on the ground surface, or processing the shale in situ. The latter approach is preferable from the standpoint of environmental impact, since the treated shale remains in place, reducing the chance of surface contamination and the requirement for disposal of solid wastes.

The recovery of liquid and gaseous products from oil shale deposits have been described in several patents, such as U.S. Pat. Nos. 3,661,423; 4,043,595; 4,043,596; 4,043,597; and 4,043,598 which are incorporated herein by this reference. These patents describe in situ recovery of liquid and gaseous hydrocarbon materials from a subterranean formation containing oil shale, wherein such formation is explosively expanded for forming a stationary, fragmented permeable body or mass of formation particles containing oil shale within the formation, referred to herein as an in situ oil shale retort. Retorting gases are passed through the fragmented mass to convert kerogen contained in the oil shale to liquid and gaseous products, thereby producing retorted oil shale. One method of supplying hot retorting gases used for converting kerogen contained in the the oil shale, as described in U.S. Pat. No. 3,661,423, includes establishing a combustion zone in the retort and introducing an oxygen-supplying retort inlet mixture into the retort to advance the combustion zone through the fragmented mass. In the combustion zone, oxygen from the retort inlet mixture is depleted by reaction with hot carbonaceous materials to produce heat, combustion gas, and combusted oil shale. By the continued introduction of the retort inlet mixture into the fragmented mass, the combustion zone is advanced through the fragmented mass in the retort.

The combustion gas and the portion of the retort inlet mixture that does not take part in the combustion process pass through the fragmented mass on the advancing side of the combustion zone to heat the oil shale in a retorting zone to a temperature sufficient to produce kerogen decomposition, called "retorting." Such decomposition in the oil shale produces gaseous and liquid products, including gaseous and liquid hydrocarbon products, and a residual solid carbonaceous material.

The liquid products and the gaseous products are cooled by the oil shale fragments in the retort on the advancing side of the retorting zone. The liquid hydrocarbon products, together with water produced in or added to the retort, collect at the bottom of the retort and are withdrawn. An off gas is also withdrawn from the bottom of the retort. Such off gas can include carbon dioxide generated in the combustion zone, gaseous products produced in the retorting zone, carbon dioxide from carbonate decomposition, and any gaseous retort inlet mixture that does not take part in the combustion process. The products of retorting are referred to herein as liquid and gaseous products.

It is desirable to form a fragmented mass having a generally uniformly distributed void volume, i.e., a fragmented mass of generally uniform permeability, so that gas can flow reasonably uniformly through the fragmented mass during retorting operations. Techniques used for excavating one or more void spaces from a retorting site and for explosively expanding formation toward the void spaces can affect the uniformity of particle size or permeability of the fragmented mass. Bypassing portions of the fragmented mass by retorting gas can be avoided in a fragmented mass having reasonably uniform permeability in horizontal planes across the fragmented mass. Gas channeling through the fragmented mass can occur when there is non-uniform permeability.

A fragmented mass of reasonably uniform void fraction distribution can provide a reasonably uniform pressure drop through the entire fragmented mass. In forming such a fragmented mass, it is important that formation within the retort site be fragmented and displaced, rather than simply fractured, in order to create a fragmented mass of generally high permeability; otherwise, too much pressure differential is required to pass a retorting gas through the retort. It is also important that the retort contain a reasonably uniformly fragmented mass of particles so that uniform conversion of kerogen to liquid and gaseous products occurs during retorting. A wide distribution of particle size can adversely affect the efficiency of retorting because small particles can be completely retorted long before a core of large particles is completely retorted.

The general art of blasing rock formations is discussed in *The Blaster's Handbook,* 15th Edition, published by E. I. DuPont de Nemours & Company, Wilmington, Delaware.

It has been proposed in U.S. Pat. No. 3,980,339 to Heald et al that oil shale be prepared for in situ recovery by first undercutting a portion of the formation to remove from about 5% to about 25% of the total volume of the in situ retort being formed. The overlying formation is then expanded by detonating explosives places in the formation to fill the void space created by the undercut. The void space into which the formation is expanded is situated on only one side of the zone of formation being fragmented, i.e., below a horizontal face at the lower boundary of the zone being fragmented. When a zone of formation is expanded toward such a single face, it can be difficult to achieve good fragmentation and uniformly distributed permeability in the resulting fragmented mass. The result can be smaller sized particles and more void space at the site of the original void space and progressively larger particles and reduced permeability as the distance from the original void space increases. The present invention provides a pre-splitting technique in which a portion of unfragmented formation within a retort site is pre-split or separated from adjacent unfragmented formation to increase the number of faces toward which formation within the retort site is expanded for forming a fragmented mass. By increasing the number of faces toward which formation is expanded, reasonably good and uniform fragmentation and permeability of the fragmented mass can be provided.

A blasting arrangement which involves pre-splitting techniques for oil shale mining is described in U.S. Pat. No. 3,466,094 to Haworth et al which concerns "room and pillar" mining of oil shale for above ground retorting. According to that patent, primary and secondary blasting holes are drilled into the face of a heading at the end of a stope. The primary blasting holes are drilled in accordance with a V-cut procedure. The secondary holes are drilled into the leading and are located in a common plane as close to the lines of the ribs as possible. The primary and secondary holes are loaded such that the primary holes have a greater average explosive charge than the secondary holes. The secondary charges are detonated first to pre-split and form fracture planes adjacent the deposit being blasted. The effect of this is to decouple the support zone or pillars from the working zone of the deposit so that vibrations induced by the primary explosive charges are transmitted to the support zones at greatly reduced intensity. Thereafter the primary charges are detonated to remove oil shale from a working zone of the deposit. Although the primary and secondary charges are commonly detonated in a single round, the secondary holes can be drilled, loaded and detonated before drilling the primary holes.

In preparing a retort site for explosive expansion, economic considerations are important. In some oil shale mining arrangements, void spaces are excavated at different levels within the retort site for providing expansion space toward which formation is blasted when forming a fragmented mass. It is desirable to develop excavation and blasting techniques that minimize the time and cost involved in excavating such multiple level void spaces and any attendant retort level drift systems, in addition to providing techniques capable of forming a fragmented mass with reasonably high permeability and a reasonably uniformly distributed void fraction.

SUMMARY OF THE INVENTION

Briefly, one embodiment of the present invention provides a method for forming an in situ oil shale retort in a subterranean formation containing oil shale. A generally horizontally extending void is formed in a lower portion of a retort site. Unfragmented formation above the void provides a face adjacent the void. Primary and secondary sub-rounds of explosive are placed in the unfragmented formation above the void. The primary sub-round is detonated for pre-splitting a portion of unfragmented formation for separating such formation from the adjacent unfragmented formation for forming at least one new face. The separated formation contains the secondary sub-round of explosive. The secondary sub-round is detonated after the separated formation commences moving under gravity toward the void and before the separated formation reaches the bottom of the void for explosively fragmenting the separated formation toward the new face and toward the face in the lower void for forming a fragmented permeable mass of particles containing oil shale in an in situ oil shale retort.

In one form of the invention, the primary sub-round of explosive is placed in a row of mutually spaced apart, upwardly converging blasting holes formed in the zone of unfragmented formation above the void. Detonation of explosive in such upwardly converging blasting holes facilitates separation of the portion of formation from the overlying formation.

DRAWINGS

These and other aspects of the invention will be more fully understood by referring to the following detailed description and the accompanying drawings in which.

DETAILED DESCRIPTION

Figure 1:
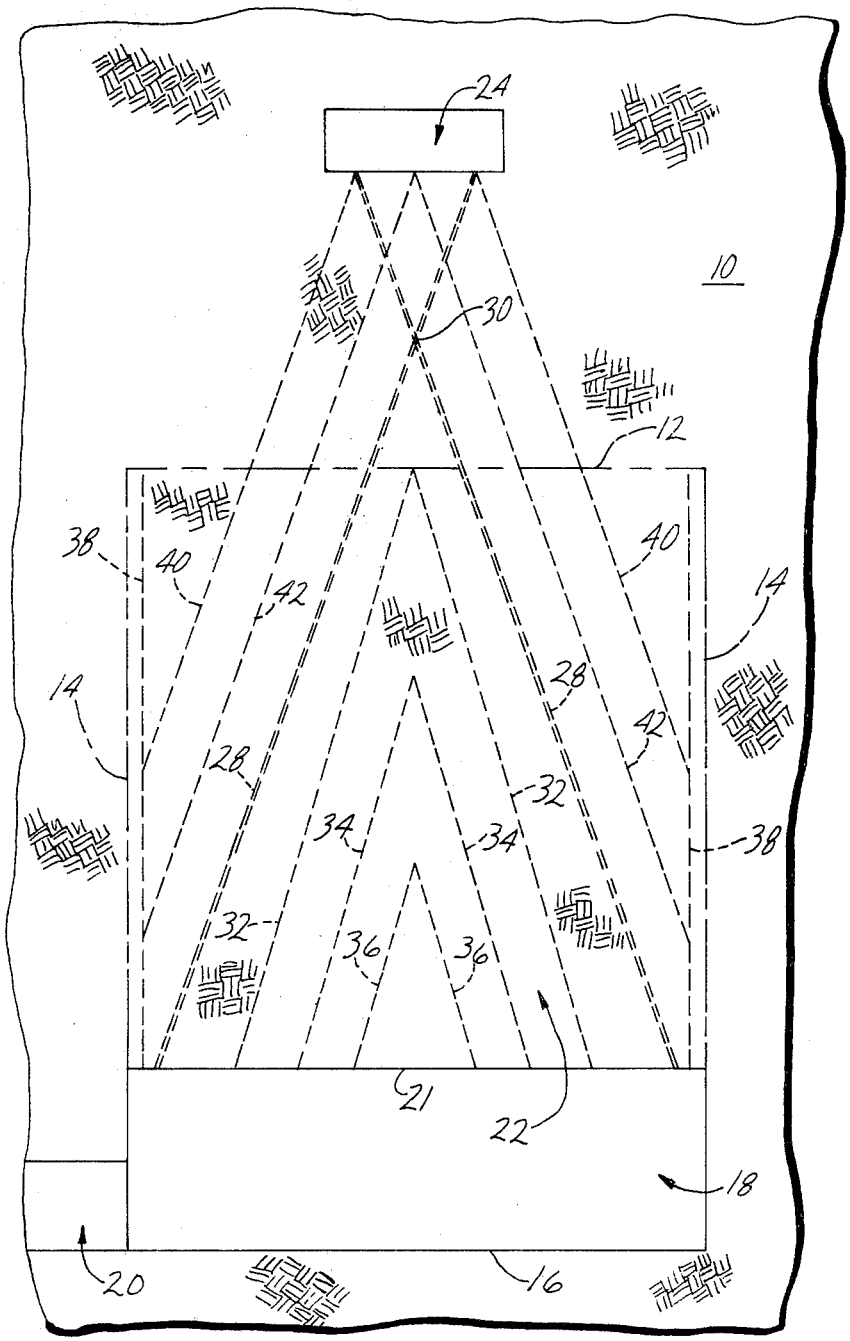
FIG. 1 is a fragmentary, semi-schematic vertical cross-sectional view showing a subterranean formation containing oil shale in a first stage of preparation for explosive expansion according to principles of this invention.
Figure 2:
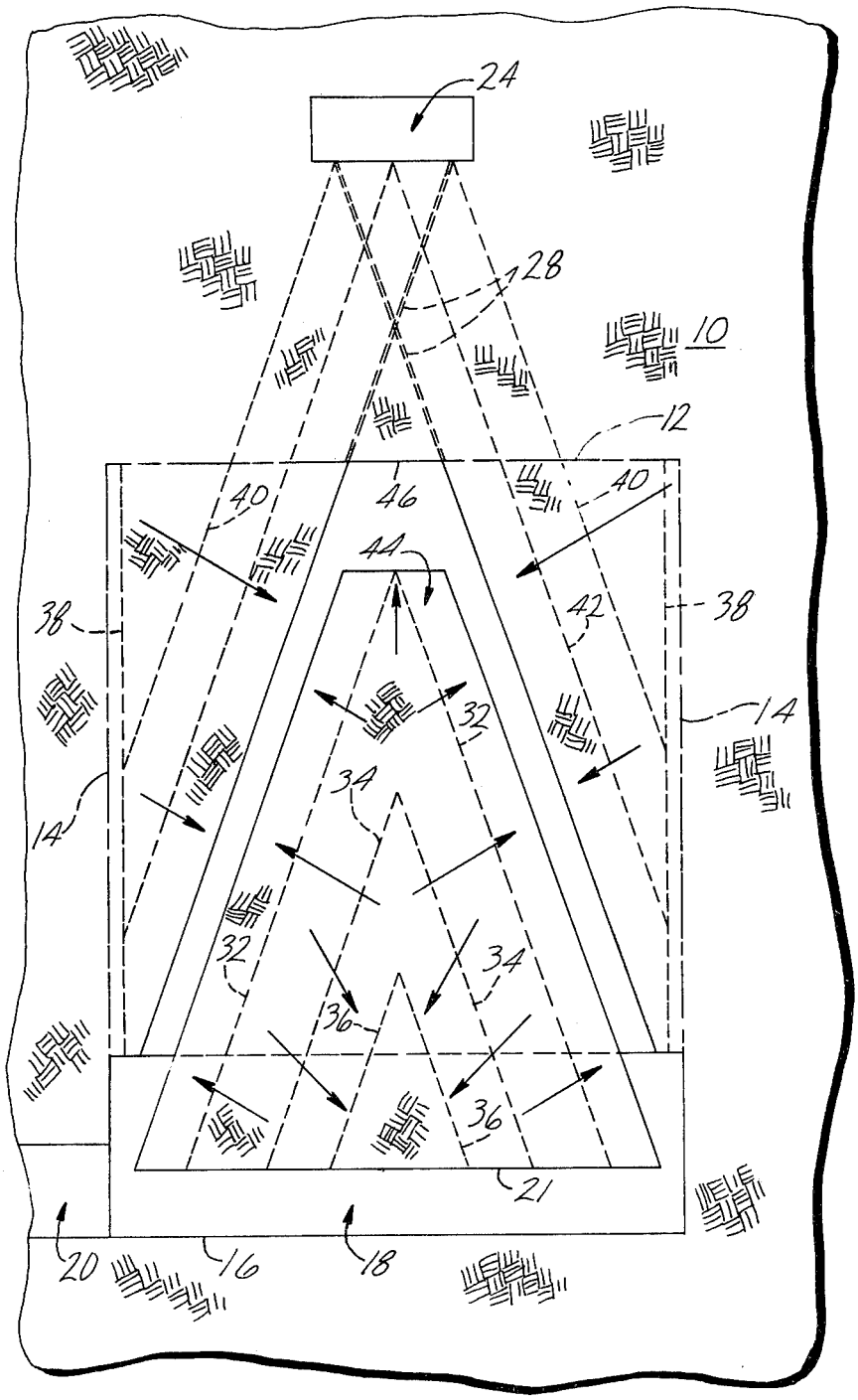
FIG. 2 is a fragmentary, semi-schematic vertical cross-sectional view similar to FIG. 1 showing an intermediate stage of the method of this invention.

The retort being formed in FIGS. 1 and 2 is in a subterranean formation 10 containing oil shale. FIG. 1 shows a preliminary stage during preparation of the in situ retort. FIG. 2 shows an intermediate stage of development. The in situ retort shown in FIGS. 1 and 2 is generally rectangular in horizontal cross-section, having a top boundary 12, four vertically extending side boundaries 14, and a lower boundary 16. If desired the retort can be square in horizontal cross-section, or considerably longer than its width.

The in situ retort is formed by excavating formation from within the retort site for forming a void or undercut 18 extending horizontally across the lower portion of the retort site. The floor of the lower level void provides the lower boundary of the retort being formed. The void is excavated by access provided by a production level access drift 20 extending on the same level as the floor of the void. In the illustrated embodiment, the height of the void is greater than the height of the production level access drift. The void is excavated so that its horizontal cross-section is substantially similar to the horizontal cross-section of the retort being formed. A face 21 of formation extends horizontally below a zone 22 of unfragmented formation within the remaining portion of the retort site above the void. The face 21 can also be referred to as a free face. The void has sufficient cross-sectional area to provide effective access to the entire horizontal cross-sectional area of the zone of unfragmented formation. The void provides a lower level base of operation that can be used for drilling and explosive loading of blasting holes formed in the overlying zone of unfragmented formation remaining within the retort site.

An air level void 24 is excavated on an upper working level. The air level void is excavated by access provided by an upper level access drift (not shown) excavated on the same level as the air level void. The floor of the air level void is spaced above the upper boundary 12 of the retort being formed, leaving a region of unfragmented formation between the floor of the air level void and the upper boundary of the retort being formed. The horizontal extent of the air level void is sufficient to provide access to an upper level base of operation. Such an upper base of operation provides an upper level means for access that can be used for drilling and explosive loading of blasting holes formed in the zone 22 of unfragmented formation within the retort site. The air level void also facilitates introduction of oxygen-supplying gas into the top of the retort being formed below it.

In excavating the lower void 18, pillars (not shown) of unfragmented formation can be left within the void. Each pillar comprises a column of unfragmented formation integral with and extending between the roof and floor of the void for providing temporary roof support for the overlying zone 22 of unfragmented formation within the retort site. Similarly, in excavating the air level void, pillars (not shown) can be left for providing roof support for overburden above the air level void.

The present invention provides a method for preparing the retort site for explosive expansion for forming an in situ oil shale retort. The zone 22 of unfragmented formation is explosively expanded into the void volume provided by excavating the lower void 18 for forming a fragmented permeable mass 26 of formation particles containing oil shale (see FIG. 4) within the boundaries of the retort site. In the illustrated embodiment, the void volume provided by the void space at the bottom of the retort site becomes distributed throughout the fragmented mass of particles upon explosive expansion for forming the fragmented mass. By explosively expanding the overlying zone into the void volume provided by excavating the lower void 18, raise drilling of void spaces or excavation of multiple voids within the retort site, together with excavating multiple drift systems, can be avoided.

The zone 22 of unfragmented formation within the retort site is explosively expanded into a limited void volume provided by the void 18. By "limited void volume" is meant that the volume of the void is smaller than the volume required for free or unconfined expansion of oil shale formation toward the void. The volume of the void is less than about 25% of the volume of the fragmented mass being formed. The preferred range is from about 15% to about 25% of the volume of the fragmented mass to be formed, and forms a fragmented mass having an average void fraction from about 15% to about 25%.

Following excavation of the lower void 18, the retort site is prepared for explosive expansion by drilling a plurality of mutually spaced apart blasting holes in the zone of unfragmented formation within the retort site above the lower void. Such blasting holes are illustrated in dashed lines in FIGS. 1 and 2. The blasting holes can be drilled upwardly from the lower void and/or downwardly from the upper level base of operation, as described in more detail below.

A primary sub-round of explosive is placed in a portion of the blasting holes within the zone of unfragmented formation. The primary sub-round is placed in a series of blasting holes referred to herein as pre-splitting holes. The pre-splitting holes are illustrated by the double dashed lines in the drawings. A secondary sub-round of explosive is placed in another portion of the blasting holes within the zone of unfragmented formation. The blasting holes containing the secondary sub-round are illustrated by the single dashed lines in the drawings. The primary sub-round is detonated for fracturing, or pre-splitting a portion of unfragmented formation in the overlying zone of unfragmented formation. This separates such portion of unfragmented formation from adjacent formation for forming at least one new face adjacent the separated portion of formation. Such a new face of formation can also be referred to as a free face. The separated portion contains the secondary sub-round of explosive, which is detonated after the new face is formed and the separated portion commences moving under gravity toward the lower void, and before the separated portion of formation reaches the bottom of the lower void, for explosively expanding the separated portion of formation. This forms at least a portion of the fragmented permeable mass 26 of formation particles containing oil shale within the retort site.

In general, the method is carried out by drilling at least a pair of upwardly converging pre-splitting holes within the zone of unfragmented formation above the horizontal face 21 adjacent the top of the lower void. A primary sub-round of explosive is placed in the upwardly converging blasting holes and the primary sub-round is detonated for pre-splitting and separating an upwardly converging, or inverted V-shaped portion of unfragmented formation from adjacent unfragmented formation within the retort site. Such a separated portion of formation contains a secondary sub-round of explosive which is detonated before the separated portion reaches the bottom of the lower void for explosively expanding the separated portion of formation.

Referring specifically to the embodiment of FIGS. 1 and 2, a row of closely spaced apart, upwardly converging pre-splitting holes 28 is drilled along the length of the zone of unfragmented formation. The pre-splitting holes are drilled in pairs that converge upwardly toward each other from opposite sides of the zone of unfragmented formation. The pairs of upwardly converging pre-splitting holes are drilled substantially parallel to each other in substantially vertical planes approximately equidistantly spaced apart along the length of the retort being formed. The pre-splitting holes are drilled downwardly from the air level void 24, and each pair of converging pre-splitting holes intersects below the air level void at an apex or point of convergence 30. The pairs of downwardly converging pre-splitting holes intersect at points of convergence spaced apart along a common horizontal plane spaced above the retort site. The pre-splitting holes are drilled on a symmetrical inverted V pattern so their points of convergence are located along a vertical plane extending along the center of the zone of unfragmented formation. In practice, each pair of pre-splitting holes need not actually meet at an apex, or point of convergence, since it is sufficient that the blasting holes terminate generally in the same vicinity, and at approximately the same level within the retort site. Although in the illustrated embodiment the pairs of pre-splitting holes meet at points of convergence spaced above the upper boundary 12 of the retort being formed, in other embodiments the points of convergence of the pre-splitting holes can be closer to or on the upper boundary of the retort being formed. The pre-splitting holes are drilled so that the bottoms of the holes intersect the horizontal face 21 at the lower void 18 near the opposite side boundaries 14 of the retort being formed. Thus, the bottoms of the pre-splitting holes are spaced apart by a distance approximately equal to the width of the retort being formed.

Separate rows of mutually spaced apart, upwardly converging secondary blasting holes are drilled on separate levels in the zone of unfragmented formation below the pre-splitting holes. These blasting holes are referred to as secondary blasting holes, inasmuch as they contain a secondary sub-round of explosive, as described in more detail below. The secondary blasting holes include a first row of upwardly converging first blasting holes 32 drilled on a symmetrical inverted V pattern and spaced immediately below the level of the pre-splitting holes. The first blasting holes are arranged in upwardly converging pairs approximately equidistantly spaced apart along the length of the zone of unfragmented formation. The first blasting holes are generally parallel to the pre-splitting holes and can have the same approximate spacing as the pre-splitting holes above them, if desired. The pairs of first blasting holes are drilled in separate substantially vertical planes, and are preferably drilled upwardly from the lower void. The pairs of first blasting holes meet generally at points of convergence extending along the center of the zone 22 of formation, said points of convergence being located in a common horizontal plane at or near the upper boundary 12 of the retort being formed.

The secondary blasting holes also include a second row of mutually spaced apart, upwardly converging second blasting holes drilled on a symmetrical inverted V pattern and spaced below the level of the row of first blasting holes 32. The pairs of second blasting holes are likewise approximately equidistantly spaced apart along the length of the zone of unfragmented formation, preferably parallel to the first blasting holes and with the same approximate spacing as the first blasting holes, if desired. The pairs of second blasting holes also are in separate substantially vertical planes and are drilled upwardly from the lower void. The second blasting holes meet generally at points of convergence extending along the center of the zone 22 of formation and located in a common horizontal plane spaced below the points of convergence of the first blasting holes.

The secondary blasting holes also can include a third row of mutually spaced apart, upwardly converging third blasting holes 36 spaced below the level of the row of second blasting holes. The third blasting holes are drilled upwardly from the lower void in a symmetrical inverted V pattern similar to that of the sets of first and second blasting holes.

Although the illustrated embodiments shows three rows of secondary blasting holes drilled at different levels below the pre-splitting holes, other arrangements of such upwardly converging secondary blasting holes can be used.

Further secondary blasting holes are drilled in the upper outer regions of the zone of unfragmented formation, along opposite sides of the retort site, where formation within such outer region is not easily accessable by drilling upwardly converging blasting holes from access provided by the lower void. The blasting holes drilled in these outer regions of the retort site are for the purpose of trimming, or "squaring of the corners" of the fragmented mass being formed. Referring to the embodiment illustrated in FIGs. 1 and 2, these blasting holes include separate rows of outer vertical blasting holes 38 drilled upwardly from the lower void adjacent opposite side boundaries 14 of the retort being formed. These outer vertical blasting holes are drilled approximately parallel to one another and can be generally equidistantly spaced apart by approximately the same spacing as the upwardly converging secondary blasting holes.

Blasting holes drilled in the upper outer regions of the retort site also include a first set of upwardly converging outer blasting holes 40 drilled downwardly from the air level void into the upper regions of the retort site above the pre-splitting holes 28. The upwardly converging outer blasting holes in the first set can be drilled generally parallel to the pre-splitting holes and arranged in a symmetrical inverted V pattern similar to that of the other pairs of converging blasting holes. That is, they can be arranged in corresponding pairs extending parallel to one another and spaced apart equidistantly along the length of the retort site. The outer blasting holes in the first set terminate near the side boundaries 14 of the retort being formed.

Similarly, a second set of upwardly converging outer blasting holes 42 is drilled down from the air level void into the upper outer regions of the zone of unfragmented formation below the first set of outer blasting holes and above the pre-splitting holes. The outer blasting holes in the second set are preferably drilled parallel to the pre-splitting holes and the first set of outer blasting holes and are arranged in a symmetrical inverted V pattern similar to that of the other pairs of converging blasting holes. The outer blasting holes in the second set terminate near the opposite side boundaries of the retort being formed.

Figure 4:
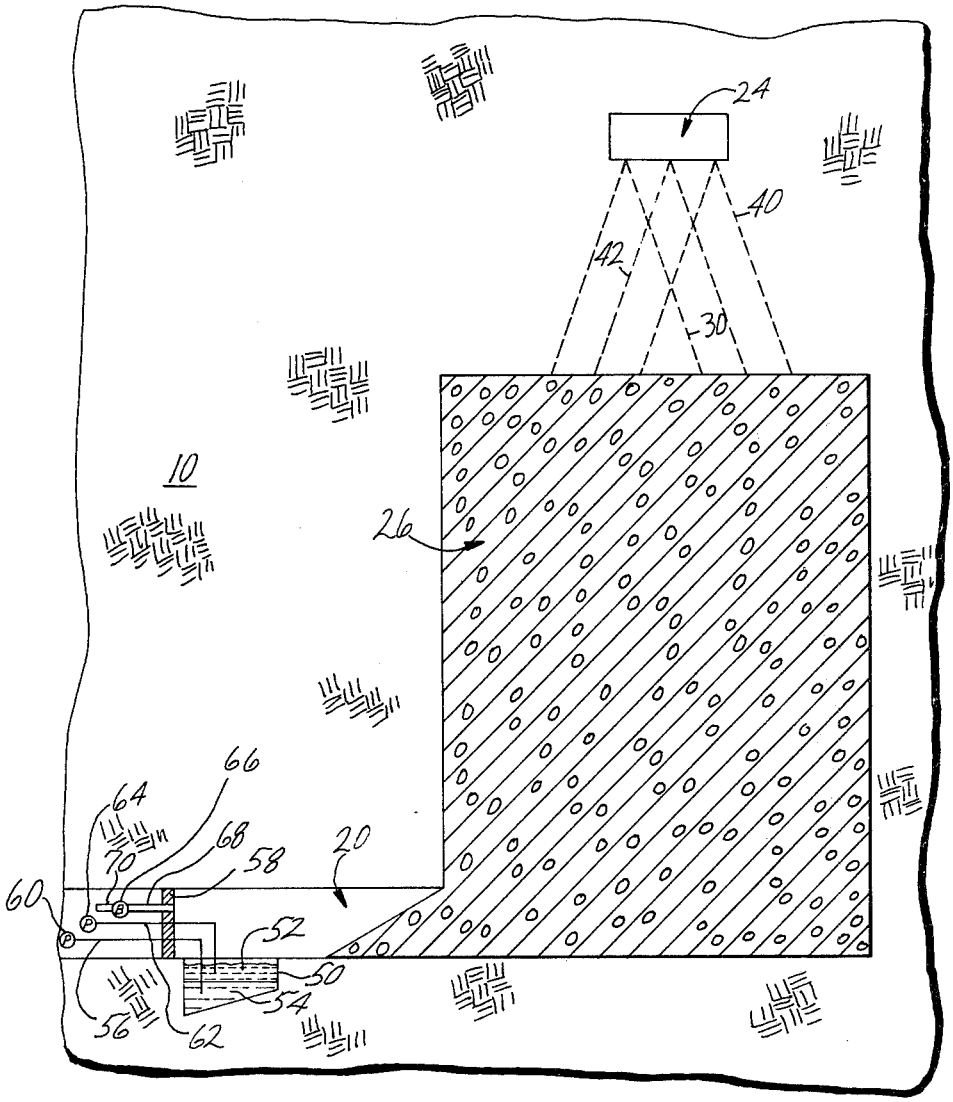
FIG. 4 is a fragmentary, semi-schematic vertical cross-sectional view showing a completed in situ oil shale retort formed according to principles of this invention.

The pre-splitting holes and the secondary blasting holes are loaded with explosive and the explosive is detonated in a single round of explosions, i.e., in an essentially uninterrupted series of explosions, for explosively expanding the zone of unfragmented formation toward the void space for forming an in situ oil shale retort containing the fragmented mass 26 illustrated in FIG. 4.

A primary sub-round of explosive is placed in the pre-splitting holes 28 and a secondary sub-round of explosive is placed in the secondary blasting holes, i.e., in the first, second and third blasting holes 32, 34 and 36 within the zone of unfragmented formation below the pre-splitting holes, and in the first, second and third sets of outer blasting holes 38, 40 and 42 in the upper outer regions of the zone of unfragmented formation. Explosive in the pre-splitting holes is detonated to fracture or pre-split formation along the converging planes of the row of pre-splitting holes containing the primary sub-round of explosive. Detonation of the primary sub-round separates an upwardly converging, i.e., an inverted V-shaped zone 44 of unfragmented formation from adjacent unfragmented formation within the retort site. Explosive within the primary sub-round is detonated substantially simultaneously, which causes a collosion of shock waves in unfragmented formation between the pre-splitting holes to create a distinct fracture plane or shear plane, effectively separating the formation situated on opposite sides of the row of pre-splitting holes. In the illustrated embodiment, explosive is loaded in the pre-splitting holes up to the upper boundary 12 of the retort site. When explosive in the pre-splitting holes is detonated, a horizontal fracture plane 46 is also produced generally across the upper boundary of the retort site between the pre-splitting holes, separating an elongated truncated, pyramid-shaped zone 44 of formation from adjacent unfragmented formation above it. The weight of the zone of formation being separated exceeds the tensile force needed to break the formation along the horizontal fracture plane 46 above the separated zone of formation.

Figure 3:
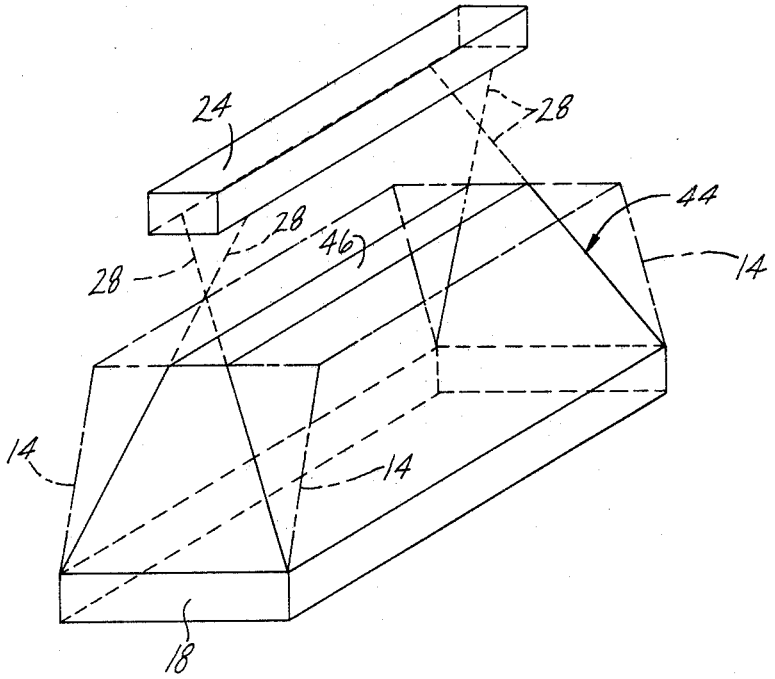
FIG. 3 is a schematic perspective view illustrating boundaries of a pyramid-shaped zone of formation to be fractured and explosively expanded according to principles of this invention.

FIG. 3 schematically illustrates the elongated truncated pyramid-shaped zone 44 of formation separated from adjacent unfragmented formation in response to detonation of explosive in the pre-splitting holes. This view illustrates pairs of upwardly converging pre-splitting holes at opposite ends of the zone of separated formation. The other pairs of converging pre-splitting holes which are spaced closely apart along the length of the zone of formation are not shown in FIG. 3 for clarity. The planes in which the pairs of upwardly converging pre-splitting holes at the ends of the separated zone are drilled can be inclined slightly from vertical as shown in FIG. 3. Owing to the pattern of the pre-splitting holes, the lower face of the zone of separated formation has a horizontal cross-sectional area similar to the horizontal cross-sectional area of the fragmented mass being formed.

The amount of explosive in the primary sub-round is sufficient to only fracture or pre-split formation along fracture planes approximately coincident with the row of pre-splitting holes containing the primary sub-round. That is, detonation of the primary sub-round does not cause appreciable fragmentation of the separated zone of formation. The explosion from detonation of the primary sub-round is of sufficiently low magnitude that the secondary sub-rounds of explosive in the separated zone of formation are not broken up or otherwise adversely effected, but remain essentially intact.

Following separation of the pyramid-shaped zone 44 of formation, the separated zone commences moving under gravity toward the lower void and forms a new face 46 above the separated zone of formation. The new face has the same truncated pyramid shape as the zone of formation being separated. Although the new face has an irregular surface shape, with faces at different angles, it can be referred to herein as a single new face.

The separated zone of formation initially remains essentially unfragmented and contains the secondary sub-round of explosive which is later detonated for explosively expanding the separated zone into a fragmented mass of particles of desired size for in situ retorting. When explosive in the primary sub-round is detonated, causing the separated zone of formation to commence moving under gravity toward the lower void, a new face is formed; and the result is that the original void space occupied by the lower void 18 has now been rearranged to provide a void space that extends all the way around the exterior of the zone of separated formation. Before the separated zone of formation 44 reaches the bottom of the lower void, the second sub-round of explosive contained in it is detonated for explosively expanding the separated zone of formation outwardly in all directions toward the new wedge-shaped face 46 and toward the lower void. FIG. 2 shows the separated pyramid-shaped zone of formation moving under gravity toward the lower void; and at about the point shown in FIG. 2, explosive within the secondary sub-round is detonated for explosively expanding the separated zone of formation outwardly into the void space that surrounds it.

Explosive in the secondary sub-round can be detonated for explosively expanding formation within the separated zone of formation and within the upper outer regions of the retort site generally in the directions of the arrows shown in FIG. 2. More specifically, formation within the separated zone is explosively expanded generally outwardly in all directions around the exterior of the separated zone, and formation within the upper outer regions is expanded generally toward the wedge-shaped face 46 along which the separated zone was fractured. As a result, all formation within the retort site is explosively expanded in a single round for forming the fragmented mass 26.

It can be desirable to initiate detonation of explosive in the secondary sub-round before explosive in the primary sub-round is actually detonated. Detonation of explosive in the primary and secondary sub-rounds can be initiated simultaneously, and following initiation in the primary and secondary sub-rounds the detonators downhole in the primary sub-round are set off first to pre-split the zone of formation containing the secondary sub-round. Time delay blasting caps downhole in the secondary sub-round, which have already been initiated, are set off after the preset time delay to explosively expand the pre-split zone of formation. The time delay between detonation in the primary sub-round and in the secondary sub-round can be from approximately 100 milliseconds to about ½ second, depending upon the minimum time required for the face to form, the height of the pre-split segment of formation, and the acceleration due to gravity. Further, explosive charges in the secondary sub-round can be detonated in a desired time delay sequence. For example, explosive in the outermost secondary blasting holes in the separated zone of formation can be detonated a fraction of a second before explosive in the innermost blasting holes is detonated. Furthermore, explosive in the second set of outer blasting holes 42 can be detonated a fraction of a second before explosive in the first set of outer blasting holes 40 is detonated.

Thus, techniques of this invention are used for separating a conical or pyramid-shaped zone of formation from adjacent unfragmented formation in such a way that the separated zone of formation moves downwardly away from adjacent formation under its own weight. This method in effect rearranges the original void space (in the lower void) by increasing the number of faces prior to explosive expansion. This is made possible by the wedge-shaped configuration of the separated zone of formation and by the action of gravity forces. By providing void space for expansion extending around the entire exterior of the separated zone of formation, and by creating new faces toward which upper outer zones of formation can be expanded, the chances of obtaining reasonably uniform fragmentation and void distribution and reasonably good permeability in the resulting fragmented mass are improved. The new faces are created without additional development or excavation within the zone of formation, such as by excavating additional void spaces at different levels prior to explosive expansion. This limits the development process to a reasonably low cost conventional and simple room and pillar mining operation on a single level.

FIGS. 1 through 3 illustrate one embodiment of the present invention, and FIGS. 5 through 8 are examples that illustrate alternative techniques for preparing a zone of formation for explosive expansion according to principles of this invention.

Figure 5:
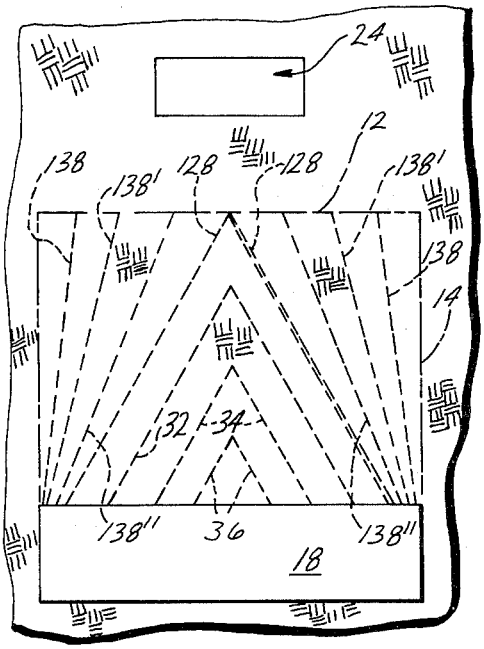
FIG. 5 is a fragmentary, semi-schematic vertical cross-sectional view illustrating a first alternative blasting arrangement for the method of this invention.
Figure 6:
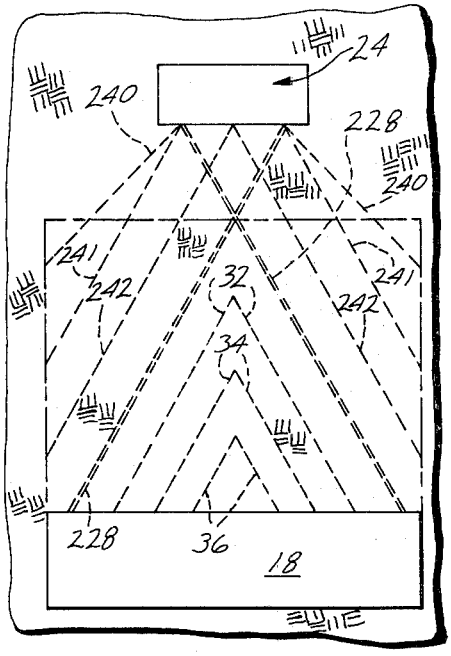
FIG. 6 is a fragmentary, semi-schematic vertical cross-sectional view illustrating a second alternative blasting arrangement for the method of this invention.
Figure 7:
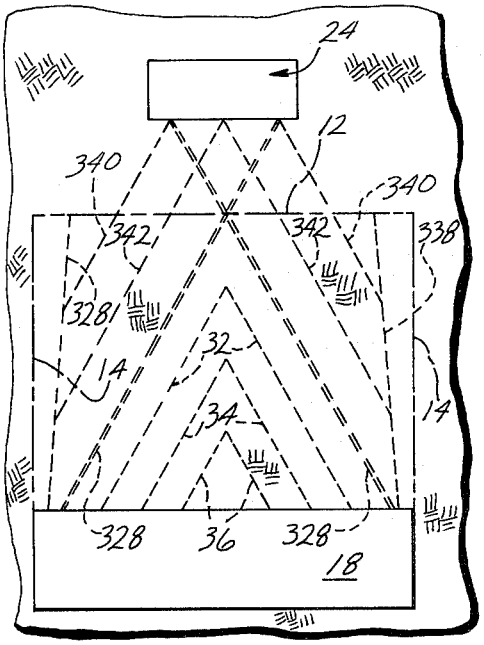
FIG. 7 is a fragmentary, semi-schematic vertical cross-sectional view illustrating a third alternative blasting arrangement for the method of this invention.

FIGS. 5 through 7 illustrate several alternative methods for drilling the pre-splitting holes and the outer blasting holes in the upper outer regions of the zone of unfragmented formation. In the embodiment illustrated in FIG. 5, all blasting holes are drilled upwardly from the lower void 18. The pre-splitting holes 128 are drilled upwardly to points of convergence generally along the upper boundary 12 of the retort site. Secondary blasting holes 32, 34 and 36 below the pre-splitting holes are drilled in a pattern similar to that of the embodiments of FIGS. 1 through 3. A first set of mutually spaced apart outer blasting holes 138 is drilled upwardly from the lower void adjacent the opposite side boundaries 14 of the retort site. The outer blasting holes in the first set are included upwardly and inwardly slightly with respect to the vertical plane of the side boundaries of the retort site. A second set of outer blasting holes 138' is spaced inwardly from the first set and drilled at an angle of lesser inclination than the angle of the first set of outer blasting holes. Similarly, a third set of outer blasting holes 138' is spaced inwardly from the second set of outer blasting holes and drilled adjacent to the pre-splitting holes at a shallower angle than the second set. The three sets of outer blasting holes are drilled with relatively uniform spacing between sets, so that explosive charges can be placed reasonably uniformly throughout the upper outer regions of formation above the pre-splitting holes.

In the embodiment of FIG. 6, the pre-splitting holes and the outer biasing holes in the upper outer regions of the zone of unfragmented formation are all drilled downwardly from the air level void 24. In this embodiment, the pre-splitting holes 228 are drilled on a pattern similar to the pre-splitting holes 28 in the embodiment of FIGS. 1 through 3. Similarly, secondary blasting holes 32, 34 and 36 are drilled in the zone of unfragmented formation below the pre-splitting holes 228 on patterns similar to the embodiment of FIGS. 1 through 3. A first set of outer blasting holes 240 is drilled downwardly on an angle from the air level void into regions near the upper outer corners of the zone of formation. A second set of outer blasting holes 241 is drilled downwardly from the air level void into central portions of the upper outer regions of unfragmented formation at angles steeper than the first set of outer blasting holes. A third set of outer blasting holes 242 can be drilled downwardly from about the center of the air level void into lower portions of the upper outer regions of unfragmented formation on angles approximately parallel to the pre-splitting holes.

In the embodiment of FIG. 7, the pre-splitting holes 328 and the secondary blasting holes 32, 34 and 36 are drilled on patterns similar to the embodiment of FIGS. 1 through 3. Separate rows of generally upright blasting holes 338 are drilled upwardly from the lower void and spaced inwardly from the side boundaries 14, extending at angles inclined slightly upwardly and inwardly from the vertical planes of the retort side boundaries. These blasting holes terminate near the upper boundary 12 of the retort site. A first set of angular outer blasting holes 340 is drilled downwardly from the air level void in a pattern similar to the outer blasting holes 40 in the embodiment of FIGS. 1 through 3, except that the outer blasting holes 340 terminate generally in the planes defined by the upright blasting holes 338. Similarly, a second set of angular outer blasting holes 342 is drilled downwardly from the air level void on a pattern similar to the blasting holes 42 in the embodiment of FIGS. 1 through 3, and these blasting holes also terminate at approximately the planes defined by the upright blasting holes 338.

Figure 8:
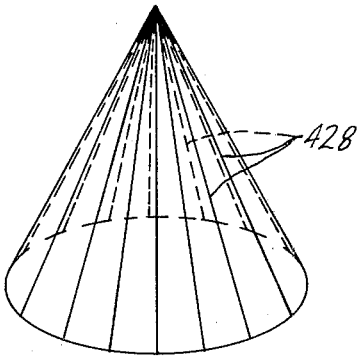
FIG. 8 is a schematic perspective view illustrating an arrangement of blasting holes for pre-splitting a conical-shaped zone of formation according to principles of this invention.

FIG. 8 illustrates that the pre-splitting holes 428 can be drilled on a conical pattern, either upwardly from the lower void or downwardly from the air level void, in addition to drilling the pre-splitting holes on a pattern that forms a generally pyramid-shaped zone of formation to be separated from adjacent unfragmented formation.

FIG. 4 illustrates a completed in situ retort in which shale oil is produced from the fragmented mass 26 produced in the embodiment of FIGS. 1 through 3. The particles at the top of the fragmented mass are ignited to establish a combustion zone at the top of the fragmented mass. Air or other oxygen-supplying gas is supplied to the combustion zone from the air level void 24 to conduits or passages extending downwardly from the air level void through unfragmented formation below the air level void to the top of the fragmented mass. The conduits or passages for the air or other oxygen-supplying gas can be provided by the upper portions of the blasting holes 28, 40 and 42, extending from the air level void to the top of the fragmented mass. Air or other oxygen-supplying gas introduced to the fragmented mass through these passages maintains the combustion zone and advances it downwardly through the fragmented mass. Hot gas from the combustion zone flows through the fragmented mass on the advancing side of the combustion zone to form a retorting zone where kerogen in the fragmented mass is converted to liquid and gaseous products. As the retorting zone moves down through the fragmented mass, liquid and gaseous products are released from the fragmented formation particles. A sump 50 in a portion of the production level drift 20 beyond the fragmented mass collects liquid products, namely, shale oil 52 and water 54 produced during operation of the retort. A water withdrawal line 56 extends from near the bottom of the sump out through a sealed opening (not shown) in a bulkhead 58 sealed across the drift. The water withdrawal line is connected to a water pump 60. An oil withdrawal line 62 extends from an intermediate level of the sump out through a sealed opening (not shown) in a bulkhead and is connected to an oil pump 64. The oil and water pumps can be operated manually or by automatic controls (not shown) to remove shale oil and water separately from the sump. The inlet of a blower 66 is connected by a conduit 68 to an opening through the bulkhead for withdrawing off gas from the retort. The outlet of the blower delivers off gas from the retort through a conduit 70 to a recovery or disposal system (not shown).

What is claimed is:

1. A method for recovering liquid and gaseous products from an in situ oil shale retort formed in an in situ retort site in a subterranean formation containing oil shale, the in situ retort containing a fragmented permeable mass of formation particles containing oil shale, the method comprising the steps of:

forming a void in a lower portion of the retort site;

placing a primary sub-round of explosive in a portion of unfragmented formation within the retort site above the void, said primary sub-round defining a boundary of said portion of unfragmented formation;

placing a secondary sub-round of explosive in said portion of unfragmented formation;

detonating the primary sub-round of explosive for fracturing such unfragmented formation generally along said boundary to separate such portion of formation from adjacent unfragmented formation for forming at least one new face adjacent the separated portion of formation, the separated portion of formation containing the secondary sub-round of explosive;

detonating the secondary sub-round of explosive after such new face is formed and before the separated portion of formation reaches the bottom of the void for explosively expanding said separated portion of formation for forming at least a portion of a fragmented permeable mass of formation particles containing oil shale in an in situ oil shale retort; and establishing a retorting zone in the fragmented mass for producing liquid and gaseous products of retorting.

2. The method according to claim 1 including detonating an inverted V-shaped array of explosive charges in the primary sub-round for separating an inverted V-shaped portion of formation.

3. The method according to claim 2 including detonating an inverted V-shaped array of explosive charges in the secondary sub-round.

4. A method for forming an in situ oil shale retort in a retort site in a subterranean formation containing oil shale, the in situ retort containing a fragmented permeable mass of formation particles containing oil shale, the method comprising the steps of:

forming a void in a lower portion of the retort site;

placing a primary sub-round of explosive in a portion of unfragmented formation within the retort site above the void;

placing a secondary sub-round of explosive in such portion of unfragmented formation above the void;

detonating the primary sub-round of explosive for presplitting such portion of formation for separating such portion of formation from adjacent unfragmented formation for forming at least one new face above the separated portion of formation, the separated portion of formation containing the secondary sub-round of explosive; and detonating the secondary sub-round of explosive after such new face is formed and the separated portion of formation commences moving under gravity toward such void, and before the separated portion of formation reaches the bottom of the void, for explosively fragmenting the separated portion of formation.

5. The method according to claim 4 including detonating an inverted V-shaped array of explosive charges in the primary sub-round for separating an inverted V-shaped portion of formation.

6. The method according to claim 5 including detonating an inverted V-shaped array of explosive charges in the secondary sub-round.

7. A method for forming an in situ oil shale retort in a subterranean formation containing oil shale, the in situ retort containing a fragmented permeable mass of formation particles containing oil shale, the method comprising the steps of:

forming a void in a lower portion of the retort site;

forming an array of upwardly converging blasting holes in a portion of unfragmented formation within the retort site above the void;

placing a primary sub-round of explosive in such blasting holes;

placing a secondary sub-round of explosive in such portion of unfragmented formation;

detonating the primary sub-round of explosive for fracturing such portion of formation above the void and for separating such portion of formation from adjacent unfragmented formation for forming at least one new face above the separated portion of formation, the separated portion of formation containing the secondary sub-round of explosive; and detonating the secondary sub-round of explosive after such new face is formed and the separated portion of formation commences moving under gravity toward such void, and before the separated portion of formation reaches the bottom of the void, for explosively expanding the separated portion of formation.

8. The method according to claim 7 in which the array of blasting holes converge to form an inverted V pattern.

9. The method according to claim 8 in which the step of placing a secondary sub-round of explosive comprises forming an array of upwardly converging second blasting holes that converge to form an inverted V pattern, and placing the secondary sub-round of explosive in such second blasting holes.

10. The method according to claim 7 in which the step of forming blasting holes comprises drilling a row of mutually spaced apart upwardly converging blasting holes in said portion of formation above the void.

11. The method according to claim 9 in which the upwardly converging blasting holes comprise separate pairs of holes that converge to form separate inverted V patterns spaced apart along the length of the retort being formed.

12. The method according to claim 7 including placing a load of explosive in the blasting holes; and detonating the explosive in the blasting holes simultaneously.

13. The method according to claim 7 in which the blasting holes in the primary sub-round converge upwardly to form a conical pattern.

14. A method for forming an in situ oil shale retort in a retort site in a subterranean formation containing oil shale, the in situ retort containing a fragmented permeable mass of formation particles containing oil shale, the method comprising the steps of:

forming a generally horizontally extending void in a lower portion of a retort site, leaving a zone of unfragmented formation remaining within the retort site, wherein such zone of unfragmented formation has a generally horizontal face adjacent the top of the void;

forming at least one row of mutually spaced apart upwardly converging blasting holes in a portion of the zone of unfragmented formation, said converging blasting holes being spaced apart along the length of the void;

placing a primary sub-round of explosive in such upwardly converging blasting holes;

placing a secondary sub-round of explosive in such portion of unfragmented formation above the void;

detonating the primary sub-round of explosive for presplitting such portion of formation for separating such portion of formation from adjacent unfragmented formation and for forming at least one upwardly converging new face above the separated portion of formation, the separated portion of formation containing the secondary sub-round of explosive; and detonating the secondary sub-round of explosive after such new face is formed and the separated portion of formation commences moving toward such void, and before the separated portion of formation reaches the bottom of the void, for explosively fragmenting the separated formation for forming at least a portion of a fragmented permeable mass of formation particles containing oil shale in an in situ oil shale retort.

15. The method according to claim 14 including detonating loads of explosive in the primary sub-round substantially simultaneously.

16. The method according to claim 14 including forming the secondary sub-round by drilling at least one row of mutually spaced apart upwardly converging second blasting holes in said portion of formation above the void, the second blasting holes being spaced apart along the length of the void; and placing explosive in the second blasting holes.

17. The method according to claim 14 in which the upwardly converging blasting holes converge generally along a central portion of the zone of unfragmented formation.

18. The method according to claim 14 in which the step of placing a secondary sub-round of explosive comprises forming separate rows of mutually spaced apart upwardly converging second blasting holes in said portion of unfragmented formation above the void and below the rows of blasting holes in the primary sub-round, the rows of second blasting holes in the secondary sub-round being spaced apart vertically from one another.

19. The method according to claim 14 in which the bottoms of the upwardly converging blasting holes are spaced apart by a distance approximately equal to the width of the retort being formed.

20. A method for forming an in situ oil shale retort in a retort site in a subterranean formation containing oil shale, the retort containing a fragmented permeable mass of formation particles containing oil shale, the method comprising the steps of:

forming a void in a lower portion of the retort site, leaving a zone of unfragmented formation within a remaining portion of the retort site above the void;

placing a primary sub-round of explosive in the zone of formation above the void, the primary sub-round being formed by explosive charges placed in an array of of upwardly converging blasting holes, in which the bottoms of such upwardly converging blasting holes, on opposite sides of the void, are spaced apart by a distance approximately equal to the width of the retort being formed;

placing at least one secondary sub-round of explosive in the zone of formation below the primary sub-round of explosive;

detonating the primary sub-round in a single round of explosions occurring substantially simultaneously for fracturing a portion of formation below the detonated primary sub-round to separate such portion of formation from adjacent unfragmented formation for forming at least one new upwardly converging face above such portion of separated formation, such separated portion of formation containing such secondary sub-round of explosive; and detonating such secondary sub-round of explosive after said new face is formed and after said portion of separated formation commences moving toward the void, and before said portion of separated formation reaches the bottom of the void for explosively fragmenting the separated portion of formation for forming at least a portion of fragmented permeable mass of formation particles containing oil shale in an in situ oil shale retort.

21. The method according to claim 20 in which explosive in the secondary sub-round is detonated in a single round of explosions with a time delay sequence progressing upwardly within the retort site.

22. The method according to claim 20 in which explosive in the secondary sub-round is placed in an array of upwardly converging second blasting holes.

23. The method according to claim 20 in which the primary sub-round of explosive comprises a row of mutually spaced apart upwardly converging blasting holes spaced apart from one another along the length of the void.

24. The method according to claim 23 in which the blasting holes in the primary sub-round converge generally along the center of the zone of unfragmented formation.

25. The method according to claim 20 in which the horizontal cross-sectional area of the separated portion of formation is approximately equal to the horizontal cross-sectional area of the retort being formed.

26. A method for forming an in situ oil shale retort in a retort site in a subterranean formation containing oil shale, the in situ retort containing a fragmented permeable mass of formation particles containing oil shale, the method comprising the steps of:

forming a void in a lower portion of the retort site, leaving a zone of unfragmented formation within a remaining portion of the retort site above the void;

placing a primary sub-round of explosive in an array of upwardly converging blasting holes formed in the zone of unfragmented formation;

placing at least one secondary sub-round of explosive in an array of upwardly converging blasting holes formed in the zone of unfragmented formation below the primary sub-round;

detonating the primary sub-round for fracturing a portion of formation above the void and for separating such portion of formation from adjacent unfragmented formation for forming at least one upwardly converging new face above the separated portion of formation, the separated portion of formation containing the secondary sub-round; and detonating the secondary sub-round of explosive in the separated portion of unfragmented formation after the separated portion of formation commences moving under gravity toward the void and before the separated portion reaches the bottom of the void, for explosively fragmenting the separate portion of formation toward the new face and toward the original void for forming at least a portion of a fragmented permeable mass of formation particles containing oil shale in an in situ oil shale retort.

27. The method according to claim 26 wherein the explosive within the primary sub-round is detonated in a single round of explosions occurring substantially simultaneously.

28. The method according to claim 26 wherein the secondary sub-round comprises explosive placed in a plurality of separate rows of upwardly converging second blasting holes, the rows of second blasting holes being vertically spaced apart from one another, the second blasting holes in each row being horizontally spaced apart from one another.

29. The method according to claim 28 in which the secondary sub-round is detonated in a single round of explosions with a time delay sequence between rows progressing upwardly within the retort site.

* * * * *